United States Patent [19]

Ostarch

[11] 3,962,834

[45] June 15, 1976

[54] METHOD OF PRODUCING A PITTED, POROUS ELECTRODEPOSITED CHROMIUM COATING

[75] Inventor: William F. Ostarch, Covina, Calif.

[73] Assignee: Van Der Horst Corporation of America, Los Angeles, Calif.

[22] Filed: Sept. 16, 1974

[21] Appl. No.: 506,385

[52] U.S. Cl. ..... 51/323; 51/326; 204/36

[51] Int. Cl.[2] ..... B24B 1/00; C25D 5/48; C25F 3/02

[58] Field of Search ..... 204/36, 35 R; 51/323, 51/326

[56] References Cited

UNITED STATES PATENTS

| | | | |
|---|---|---|---|
| 2,314,604 | 3/1943 | Van der Horst | 204/26 |
| 2,412,698 | 12/1946 | Van der Horst | 309/2 |

*Primary Examiner*—G. L. Kaplan

*Attorney, Agent, or Firm*—Townsend and Townsend

[57] ABSTRACT

A simple and more efficient process is provided for producing deep, non-connected pit type, porous chromium surfaces with more constant and uniform characteristics. A substrate is initially electroplated with an excess of chromium having predetermined physical and chemical properties. The chromium surface is then diamond abrasive grit honed to within a specific excess of the desired final size, followed by D.C. reverse etching at a predetermined rate of ampere minutes per square inch, and finally honed with conventional type abrasive honing stones to a desired bearing surface. Under magnification, the resulting surface reveals a specific type and degree or percentage of plateaus and depressions, herein called porosity and a specific depth of pits. Simultaneously, with the surface treatment, the chromium plated product is obtained within a required size or dimension.

1 Claim, No Drawings

METHOD OF PRODUCING A PITTED, POROUS ELECTRODEPOSITED CHROMIUM COATING

BACKGROUND OF THE INVENTION

1. Field of the Invention

Electroplated chromium, as a surface material, has many advantages. It is hard and corrosion resistant, has a low coefficient of friction and is a good conductor of heat and electricity. Accordingly, it is greatly used as a surface material in the manufacture of new and in the repair of worn industrial equipment for purposes of extended life, greatly improved performance or in the economical salvaging to size of worn components. However, where electrodeposited chromium is involved in a use which involves friction and where lubrication is a requirement and especially in those areas operating under boundary lubrication conditions, an electroplated chromium surface with none or an insufficient amount of porosity, tends to gall or seize due to its inability to wet or to retain sufficient lubrication; on the other hand, if percentage or degree of porosity is too excessive or if the bearing plateau sizes are too small, lubricant can be wasted or mating parts may wear excessively. Internal combustion cylinders and liners, compressors, pistons, piston rods, piston rings and similar type industrial equipment are prime examples of equipment requiring porosity in a chrome surface. In addition to the requirement of a porous chrome surface, it is desirable and advantageous to have a certain degree or percentage of non-connected type pits of a specific geometry, to retain lubricant and lubricate a surface uniformly without excessive waste as is generally the case with a deep network type porous chromium.

2. Description of the Prior Art

U.S. Pat. Nos. 2,314,604, 2,412,698, 2,755,242 and 2,947,674, all describe treatment of chromium surfaces to provide a porous wear-resistant chromium surface. Other methods involve substrate roughening by pressure grit blasting or selective machining before chromium plating followed by subsequent limited honing, polishing or grinding to provide a porous chrome surface. Another method is to diamond hone a surface and use as is or followed by fine abrasive blasting or finally honing the rough diamond produced surface with a suitable stone to produce pits and plateau bearing surfaces. Another method is to hone or grind a chromium surface to size, followed by D.C. reversing with the product used as is or further treated by light honing to produce a porous chrome surface, which consists of a connected type network of cracks.

The text, *Chromium Plating*, by Morisset, et al., Robert Draper Ltd., Middlesex, England, 1954, describes the nature of the chromium surface and its treatment, pages 123–129.

SUMMARY OF THE INVENTION

An economical, efficient and accurate method is provided for controlling the size of an electrodeposited chromium plated article to narrow tolerances, while introducing into the surface, a plurality of pits or depressions to provide a high degree of porosity to give to the chromium surface the desired degree of wettability. A substrate is plated with chromium by electrolytic deposition in an amount greater than the desired size of the final article. A major portion of the excess chromium is removed by diamond honing, so as to provide a rough surface, which relatively closely approximates the final size of the product. The chromium surface is then subjected to reverse D.C. etch, removing a small proportion of the chromium from the surface, so that the surface closely approximates the final size. The reverse D.C. etched surface is then subjected to honing with a vitrified stone powder, providing the desired degree of porosity as indicated by the number and depth of pits on the surface and the desired size within a narrow range of tolerance.

DESCRIPTION OF THE SPECIFIC EMBODIMENTS

An economical, efficient and accurate method is provided for controlling the size or dimension of a thick (0.003 – 0.100 in.) electrodeposited chromium surface with predetermined or with any desired physical and chemical properties and within narrow tolerances, in the order of 0.001 inch, while introducing into the surface a predetermined amount of any desired degree of non-connected pit type porosity within an accuracy of 5% and with the depth of the pits being in the order of 0.002 – 0.003 inch, or deeper, if desired.

The subject invention is applicable to those substrates or manufactures where a hard corrosion resistant surface is desirable. The chromium surface produced by the subject invention is particularly applicable to cylinders for engines, pumps, compressors, and the like. The process can also be used with advantage for chromium or chromiumfaced wearing members of other kinds. In effect, the subject process is applicable to members tending to wear by frictional contact with cooperating members, where the retention of a fluid lubricant between the contacting members is desirable, or where the chromium is liable to be picked up.

In carrying out the subject invention, a substrate is employed which is to be chromium plated. The choice of conditions for the plating is determined by the character of the desired chromium coating. Higher temperatures, higher chromic acid concentration, lower sulphate and catalyst concentrations and lower current densities will result in a more dense and corrosion resistant electrodeposit; conversely, with opposite conditions, electrodeposits will be less dense and of greater hardness. The parameters are interrelated and can be varied to compromise one or more properties.

In the electrolytic deposition, temperatures will normally exceed 100°F, usually exceeding 110°F, and generally will not exceed 160°F. The current density will generally range from about 175 to about 600 amp/ft$^2$. A chromic acid solution with catalyst, usually sulphate, is employed. For further details, see Morisset, supra, 78–85.

Because of the high cost of chromium plating, and the high cost of processing the hard chromium surface to remove excess chromium, usually the excess chromium based on diameter will be only a few thousandths, generally ranging from about 5 to 50 thousandths of an inch in excess.

The first treatment of the chromium surface will be diamond honing, using diamond grit size of from about 30 to 200, more usually from about 50 to 100. The honing or grinding employing diamond grit uses conventional mechanical equipment, which provides for careful control of the amount of chromium removed. Normally, one can control to within about 0.001 inches by the initial honing. When the desired size has been achieved, the surface will be highly roughened with substantial surface stress. The amount of chromium removed will generally be at least about 55% of the total chromium to be removed and may be as high as 85%.

The chromium surface will now be subjected to a D.C. reverse etch at a current density of about 10–40, usually 15–30, and preferably 20–25 amp-min/in$^2$. In the reverse etch, the exposed face of the chromium is positively charged in any electro-corrosive solution but preferably in a chromic acid solution with little or no catalyst ion.

The plateaus which appear under magnification on the chromium surface will vary in size depending on the manner and conditions of plating and the amount of D.C. reverse. Smaller plateau sizes relate to lower density and greater hardness, while larger plateaus relate to higher density and greater corrosion resistance. Plateaus will generally range in average plateau size from about 0.002 to 0.015 inches and under specific conditions, can be controlled within a 0.001 inch to 0.002 inch in the above range.

The chromium surface is then subjected to honing using conventional abrasive grit or similar cutting stone. The hardness of the stone will generally be I-O, more usually J-K, with the grain size ranging from about 80–500 grit, more usually from about 100–300 grit.

Usually, 0.003 to 0.004 inch will be removed on diameter after a 20 to 25 a.m.s.i. D.C. reverse and final honing and will result in 30 to 35 percent porosity. Less or more D.C. reverse on final honing will result in more or less total diametrical removal or greater or less degree and depth of porosity.

The reverse etch and final honing are employed cooperatively to achieve the final dimensions and the desired degree of porosity. After the diamond abrasive honing, a specific quantity of D.C. reverse as expressed in ampere minutes per square inch plus subsequent conventional honing to a specific type degree or percentage of porosity will result in a specific total removal of chromium surface; or inversely, with a specific degree of ampere minutes per square inch of D.C. reverse and subsequent final honing for a specific degree of total surface removal, the resultant type, degree or percentage of porosity will remain fixed.

To illustrate the invention, a new cast iron, 4 cycle cylinder liner will be considered. Assume that the length is 50 inches, the final diameter size and tolerance is is 17.000 inches ± .002 inches, .000 inches a non-connected pit type porosity of 30% – 35% with 0.002 – 0.003 inch depth is desired, and a desired minimum net diametrical thickness of 0.019 chromium is desired, with a compromise of physical and chemical properties:

The inside diameter of the cylinder liner is first honed and polished oversize to 17.019 inches ± .002 inches .000 inches and with a surface finish of 10 r.m.s. or better, using roughing stones similar to Bay State Abrasive Co. No. C1006-JVQ2 No. 10 and emery cloth, similar to aluminium oxide No. 180 grit for polishing.

After some preparatory work which consists of abrasive wheel radiusing of corners and plugging of any oil holes and suitable cleaning, the cylinder liner is clamped in a plating fixture and a lead anode of approximate size 15½ inches diameter is insulated from and centrally positioned within the cylinder. After suitable treatment for adhesion purposes, the liner is then connected to the minus pole (−) and the anode is connected to the positive pole (+) and the liner is chromium plated in excess on the diameter. The concentration of the chromic acid is 250g/l. and the sulphate catalyst is maintained at 2.5g/l. It is preferred that both be controlled respectively within a range of 97–103 to 1 ratio. Bath impurities can be at a level which results when the trivalent chromium concentration ranges from 3 to 15g/l. A cathode (−) current density of 3 amperes per sq. inch or 8,000 amperes is utilized. The solution temperature is maintained at 140° – 142°F.

After chrome plating and disassembly and after suitable radiusing of corners, the inside diameter of the chromium plated cylinder is then diamond abrasive honed to size 16.997 – 16.998 inches utilizing Wickman Products Co. diamond hone stones MHM58N5 or similar types. After suitable cleaning of the chromium surface, the cylinder liner is again clamped in a plating type fixture and a steel anode of approximate size 15½ inches diameter is then insulated from and centrally positioned within the liner. The assembly is then immersed in a chromic acid solution with approximately the same limits as the plating solution, but with little or no catalyst present. The liner is connected to the positive pole (+) and the steel anode is connected to the minus pole (−). The chromium surface is then D.C. reverse etched for 20 a.m.s.i. or 10 minutes at 5,338 amperes. The cylinder is then disassembled and rinsed.

The inside diameter of the liner is then abrasive grit honed utilizing "Bay State Abrasive Co." hone stones "A 100 JVL 2 No. 10" or similar abrasive and periodically the bore is examined with a Borescope of approximately 50 magnification until a degree or percentage of pit type porosity of 30% to 35% is reached and the honing is then stopped. After cooling to room temperature, the inside diameter of the liner is within 17.000 inches ± .002 inches. .000 inches The corners or ends of the liner are abrasive wheel radiused, plugs or any shields are removed from oil holes, etc. and the cylinder liner is suitably cleaned.

The surfaces prepared in accordance with this invention are readily prepared to the desired dimensions and specific type and degree of non-connected deep pit type porosity. They provide an excellent surface for lubricating, while still retaining the hardness and corrosion resistance of hard chrome deposition.

Although the foregoing invention has been described in some detail by way of illustration and example for purposes of clarity of understanding, it will be obvious that certain changes and modifications may be practiced within the scope of the appended claims.

What is claimed is:

1. A method for producing a pitted porous layer of an electrodeposited chromium initially deposited in excess of the final layer thickness which comprises the steps of:

honing said chromium layer with fine diamond grit of from about 40–100 grit size to remove from about 55–80% of the total chromium to be removed and to allow for subsequent D.C. reverse and final hone to said final layer thickness;

D.C. reverse etching at a specific a.m.s.i. said honed surface; and honing said etched surface with an abrasive grit stone of a hardness in the range of I-M and of a grit size in the range of 100–300 to a final dimension, wherein the surface is pitted and wettable, and the pits are nonconnected.

* * * * *